United States Patent [19]

Murray

[11] 3,988,048

[45] Oct. 26, 1976

[54] DISH STABILIZERS

[76] Inventor: James M. Murray, 9129 S. Crescent Court, Oak Lawn, Ill. 60453

[22] Filed: Sept. 23, 1974

[21] Appl. No.: 508,343

[52] U.S. Cl. ..... 312/352

[51] Int. Cl.[2] ..... A47B 97/00

[58] Field of Search ..... 256/45; 220/93; 269/32, 269/287, 289; 312/228, 352; 206/.82, .83, 75, 520; 43/7; 85/1; 211/180, 13, 1, 126, 60; 140/7; 248/500, 361 R, 499; 264/DIG. 81; 134/126, 137, 201, 154, 182, 183; 160/54; 16/1, DIG. 3; 210/DIG. 9, 167

[56] References Cited

UNITED STATES PATENTS

| | | | |
|---|---|---|---|
| 1,341,552 | 5/1920 | Goss | 43/7 |
| 1,552,269 | 9/1925 | Brocker | 43/7 X |
| 1,883,965 | 10/1932 | Kratz | 16/1 |
| 2,150,560 | 3/1939 | Ozer | 134/183 X |
| 2,907,470 | 10/1959 | Abresch | 211/126 |
| 2,952,510 | 9/1960 | Naken | 206/75 |
| 3,041,915 | 7/1962 | Ryffel | 264/DIG. 81 |
| 3,051,987 | 9/1962 | Mercer | 264/DIG. 81 |
| 3,181,704 | 5/1965 | Thomas | 211/126 |
| 3,616,806 | 11/1971 | Randall | 134/199 X |

FOREIGN PATENTS OR APPLICATIONS

| | | | |
|---|---|---|---|
| 55,690 | 6/1911 | Switzerland | 43/7 |

*Primary Examiner*—James T. McCall

[57] ABSTRACT

A mesh adapted to be lowered on a group of dishes distributed in the work basket of a dish washing machine. The mesh is composed of crossed strands which are loose and render the mesh limp. The mesh is fitted with a distribution of soft-surfaced weights which depress sections of the mesh to fill spaces between the dishes and drape around them, checking dishes from upsetting or colliding during the dish washing operation.

1 Claim, 4 Drawing Figures

DISH STABILIZERS

This invention relates to the distributed placement of dishes in the work basket of a dish washing machine, and more particularly to the maintenance of the dishes as deposited for efficient cleaning during the dish washing operation. At such time cleaning solutions in jet form exert upward and lateral pressure on the dishes, and there is therefore a tendency for them to turn, collide and even to cause damage to some, such as in the case of delicate porcelain or thin glassware. Also, for cleaning in a dish washing machine the dishes are laid with hollows on the under side for direct impact by the jets of cleaning solution. Therefore, such impact often causes the dishes to turn with their hollows sidewise or up and therefore away from the jets of cleaning solution. In view of these conditions, it is one object of the present invention to provide a covering for the dishes which will stabilize them against turning and colliding influences during the cleaning operation.

A further object is to provide a covering for the purpose specified in the form of an open mesh which allows the full passage of the cleaning solution jets into and between the dishes when the work basket in which they are contained is located in the dish washing machine.

Another object is to design the covering as a mesh which is relatively firm marginally, but limp across its surface for covering the dishes and draping around them to keep them apart.

A still further object is to construct the mesh of flexible strands, and with a distribution of weights thereon which pull the mesh down between the dishes to check turning and colliding tendencies thereof.

An important object is to make the weights of heavy substance and spherical shape, so that they may glide free of entanglement in the mesh, and to make the weights soft externally for cushioned contact with the dishes.

A better understanding of the invention may be gained by reference to the accompanying drawing, in which FIG. 1 is an elevation of a typical work basket for the purpose mentioned, with an array of dishes therein held in place by the novel stabilizer;

Figure 1:
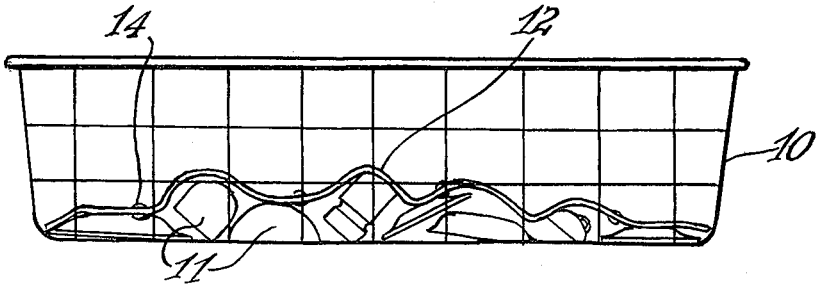

Referring specifically to the drawing, 10 denotes a work basket in which a distribution of dishes 11 is deposited; and the dishes are shown with hollows on the under side for cleaning when the work basket is inserted in a dish washing machine.

Figure 2:
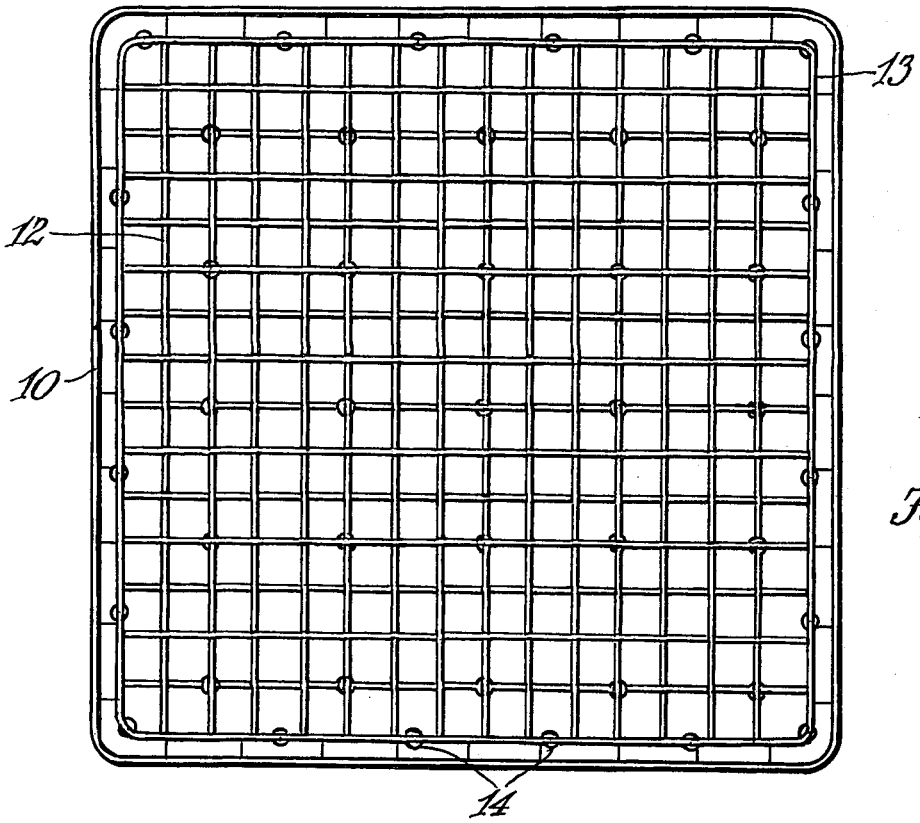
FIG. 2 is a plan view of the stabilizer.

The novel stabilizer is a mesh 12 which has the form of the work basket, and may be square as shown in FIG. 2 or round; and the rim 13 of the mesh is of relatively firm substance, such as plastic or textile cordage. The mesh is composed of crossed strands of soft but durable textile or plastic material, and so loose that the mesh has a limp consistency. At spaced intervals the rim and the crossed areas of the mesh strands receive spherical weights 14. These are of glass or porcelain, and encased in soft jackets 14*a*.

Figure 3:
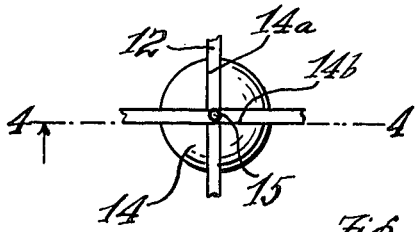
FIG. 3 is a plan view of a weight element contained in the stabilizer.
Figure 4:
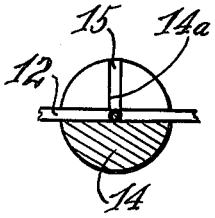
FIG. 4 is a section on the line 4—4 of FIG. 3.

While the weights 14 may be attached or sealed to the strand crossings in any suitable manner, a simple way to secure them is shown in FIGS. 3 and 4. Thus, each weight is divided half-way down with crossed slots 14*a* and 14*b*. The crossed strands of the mesh are deposited into the slots. A plug 15 is then driven into the center of the weight to fasten the strands in the same. If it is desirable, weights may also be secured to the strands at points other than the crossed areas, and along the rim 13 as shown in FIG. 2, and made tight as stated.

The size of the present mesh is for full but free lowering into the work basket, until the mesh comes to rest on top of the dishes. However, the weights will co-act to depress sections of the mesh into the spaces between the dishes, with the mesh draping around them. This will insure the separation of the dishes, and resist tendencies thereof to turn sidewise or over, or to slide against adjoining dishes. All the dishes will therefore remain as deposited. Also, when the loaded work basket is inserted into a dish washing machine, the open mesh will permit the free passage of the cleaning solution jets, but protect the dishes from being raised and turned sidewise or over by the force of the upward jets. Further, the weights 14 are cushioned on the exterior for safe contact with delicate dishes or fragile glassware. Also, the spherical form of the weights substantially reduces their chances to catch or snag anywhere in the mesh in case the same tends to gather or fold in some parts of its surface. Finally, the novel stabilizer is a simple accessory which may be kept in a handy place for use whenever desired.

I claim:

1. A stabilizer for dishes distributed in the work basket of a dishwashing machine, comprising a substantially horizontally disposed limp mesh adapted to be lowered to cover the dishes, and a plurality of weights attached to and distributed randomly across the surface of said mesh to depress sections of said mesh into the spaces between the dishes so as to drape portions thereof around the dishes when the mesh is lowered upon them, thereby to restrain the dishes from lateral and vertical movement in said basket during the dishwashing operation, said weights comprising spherical material covered with a cushioning material on the exterior, each weight having a crossed slot extending half-way through the diameter of the weight and a plug having a configuration substantially identical to the crossed slot to be driven into the weight to fasten at least one strand of said mesh therein.

* * * * *